US005154511A

United States Patent [19]

Veneskey

[11] Patent Number: 5,154,511

[45] Date of Patent: Oct. 13, 1992

[54] TROUBLE-LIGHT WITH ROTATABLE SHIELD

[76] Inventor: Daniel R. Veneskey, 4721 Forest Edge Dr., Brooklyn, Ohio 44144

[21] Appl. No.: 802,230

[22] Filed: Dec. 4, 1991

[51] Int. Cl.[5] ..... F21V 1/10

[52] U.S. Cl. ..... 362/282; 362/376

[58] Field of Search ..... 362/376, 378, 277, 282, 362/296, 319, 322

[56] References Cited

U.S. PATENT DOCUMENTS

| | | | |
|---|---|---|---|
| 1,692,892 | 11/1928 | Floyd . | |
| 2,245,686 | 6/1941 | Kollath . | |
| 2,318,329 | 5/1943 | Popp . | |
| 2,510,001 | 5/1950 | Van Duzer . | |
| 2,554,565 | 5/1951 | Fike . | |
| 2,602,880 | 7/1952 | Engelhardt et al. | 362/378 |
| 2,788,438 | 4/1957 | Lieuwen . | |
| 3,755,668 | 8/1973 | Moreschini . | |
| 4,272,803 | 6/1981 | Johnson . | |
| 4,298,922 | 11/1981 | Hardwick . | |
| 4,305,120 | 12/1981 | Lacinski . | |
| 4,369,487 | 1/1983 | Carlow | 362/376 |
| 4,594,647 | 6/1986 | Dippert . | |
| 4,774,647 | 9/1988 | Kovacik et al. | 362/378 |
| 4,864,477 | 9/1989 | Engelman | 362/376 |
| 5,072,352 | 12/1991 | Rosenschein | 362/378 |

*Primary Examiner*—Richard R. Cole

*Attorney, Agent, or Firm*—Cushman, Darby & Cushman

[57] ABSTRACT

A trouble-light having a handle member which includes an upper portion, a central portion, a lower portion, and an electrical cord for connecting to a power source. The upper portion includes a light socket for receiving a light source. The trouble-light also includes a shield having a concave, partial shell portion which surrounds a portion of the light source. The shield is rotatably mounted to the handle portion for manually directing light to a desired area. A cage member extends upwardly from the handle member and surrounds the light source and the shield. A locking mechanism is provided for retaining the shield in a selected orientation.

8 Claims, 3 Drawing Sheets

TROUBLE-LIGHT WITH ROTATABLE SHIELD

BACKGROUND OF THE INVENTION

1. Field of the Invention

This invention relates to a trouble-light, and more particularly, to a trouble-light with a rotatable shield for shielding the user's eyes and thereby directing light only in a desired direction, and which remains in a selected position until a new position is desired.

2. Description of the Related Art

Trouble-lights conventionally are used to provide light to a work area which ambient light does not illuminate.

Conventional trouble-lights are in the form of a socket for receiving a light bulb at the end of an electrical cord. A cage surrounds the bulb and a hook is defined at the apex of the cage for hanging the light in close proximity to the work area. A portion of the cage is defined by a gate or door to access and replace the bulb and a portion of the cage is non-perforated to define a shield. The shield is intended to prevent the light from shining in the worker's eyes. It is a necessity to position the trouble-light in such a manner so to direct light to the work area, while shielding the worker's eyes. However, when hanging the trouble-light, it may be impossible to direct light in a desired direction, since there are limited positions in which it can be hung. Also, once the trouble-light is hung, twisting of the extension cord of the trouble-light may cause unwanted rotation of the light.

In an attempt to alleviate these problems, several prior art trouble-lights have been equipped with rotatable hooks. For example, U.S. Pat. No. 4,305,120 provides a rotatable hook for a drop light. While the hook can be rotated independently from the cage and shield, the shield may still rotate so that light is directed away from the work area and into the worker's eyes, particularly if the cord is twisted. This occurs because the shield is affixed to the handle which is in turn affixed to the cord.

Another approach to solving this problem is disclosed in U.S. Pat. No. 4,594,647 wherein a trouble-light is equipped with a rotatable shield having an adjustment knob independent from the hook. The hook is fixed with respect to the cage. The adjustment knob is located at the top of the shield and extends through the cage. A disadvantage of that system is that there is no way of locking the shield in position and, therefore, it may shift from its selected position simply if the trouble-light is inclined or jostled. In addition, the adjustment knob is difficult to access and may become hot to the touch due to heat transfer from the light bulb thereto.

Accordingly, it can be appreciated that a need exists to provide an improved trouble-light with a shield which can be independently adjusted to direct light in a desired direction and shield the worker's eyes, and which overcomes the inadequacies of the prior art.

SUMMARY OF THE INVENTION

An object of the present invention is to fulfill the need referred to above. It also is an object of the present invention to provide an apparatus of the type described, which is simple in construction, effective in operation and economical to manufacture.

In accordance with the principles of the present invention, these and other objectives are obtained by providing a trouble-light apparatus comprising a handle member for gripping the apparatus, including a lower portion, an upper portion and a central portion, and an electrical cord for connecting to a power source. The central portion preferably includes a switching means for controlling the delivery of electric current through the handle to the light source and an electrical outlet which also is supplied by the electrical cord. The upper portion includes an electrical light socket for receiving a light-source such as a light bulb.

An openable cage extends from the upper portion to enclose the light bulb. A groove is defined circumferentially of the handle, distally of the juncture of the cage and the handle and is thus within the cage. The trouble-light apparatus also comprises a shield element having a ring-shaped end portion and a concave, partial shell which is disposed about a portion of the light source when the end portion engages the groove. The shield element is manually rotatable about the light source by reaching through the cage and gripping and rotating the end portion. Thus, the cage surrounds the light source and shield element, without interfering with the movement of the shield element. In a most preferred embodiment, the shield is provided with a locking mechanism which retains it in a selected position.

Other objects, features and characteristics of the present invention, as well as the methods of operation and functions of the related elements of the structure, and the combination of the parts and economies of manufacture, will become more apparent upon consideration of the following detailed description and appended claims with reference to the accompanying drawings all of which form a part of this specification.

DETAILED DESCRIPTION OF THE INVENTION

Referring now more particularly to the drawings, there is shown a work-light apparatus, generally indicated at 10, which embodies the principles of the present invention. The apparatus 10, includes a handle assembly, generally indicated at 12, a cage member, generally indicated at 14, a shield element, generally indicated at 16, and a light source 18.

Figure 1:
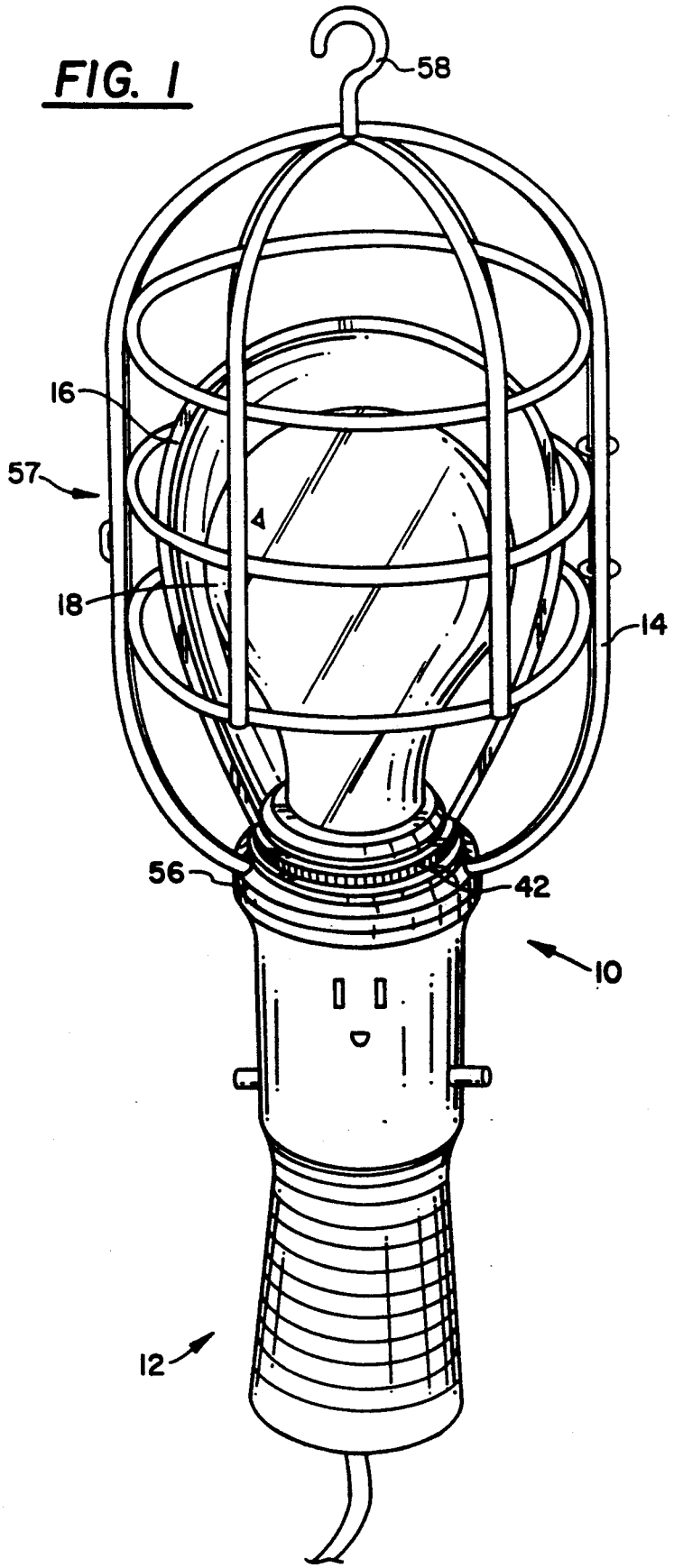
FIG. 1 is a perspective view of a trouble-light provided in accordance with the principles of the present invention.
Figure 2:
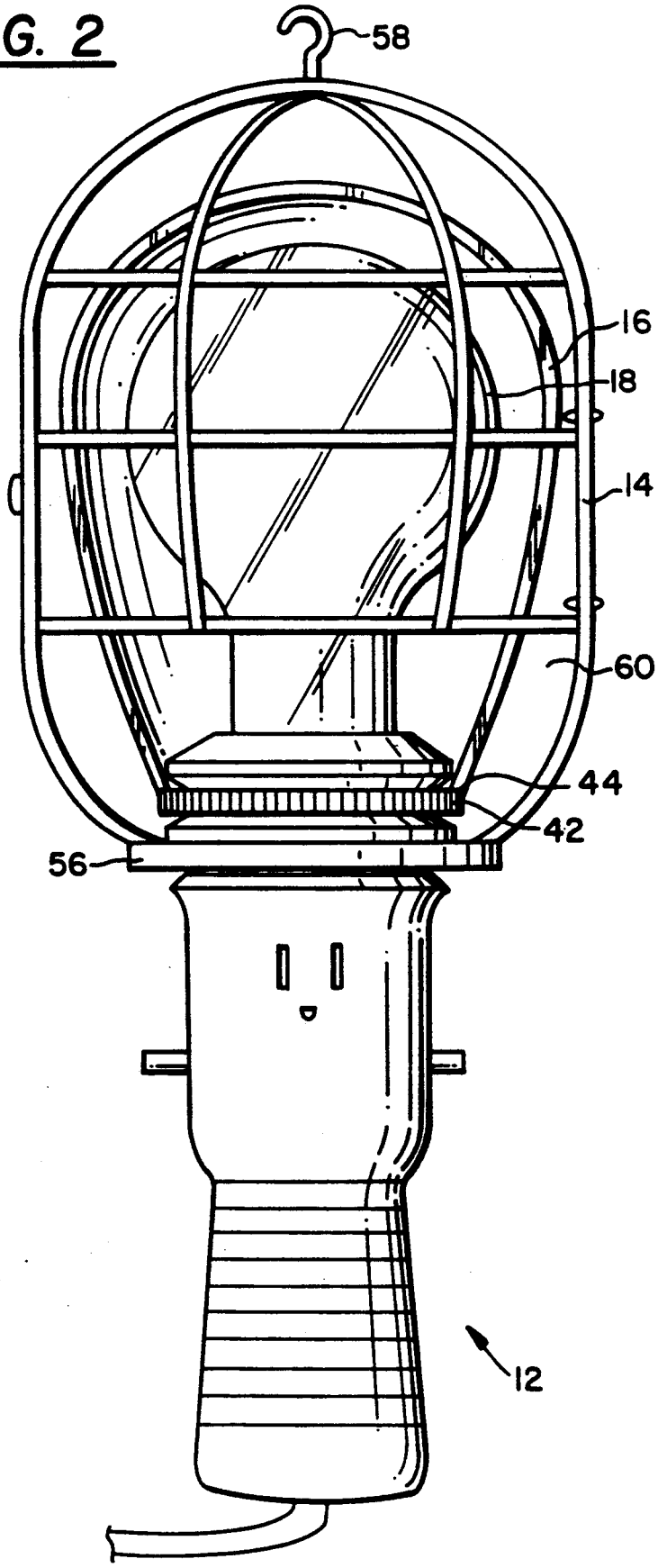
FIG. 2 is a front plan view of FIG. 1.
Figure 3:
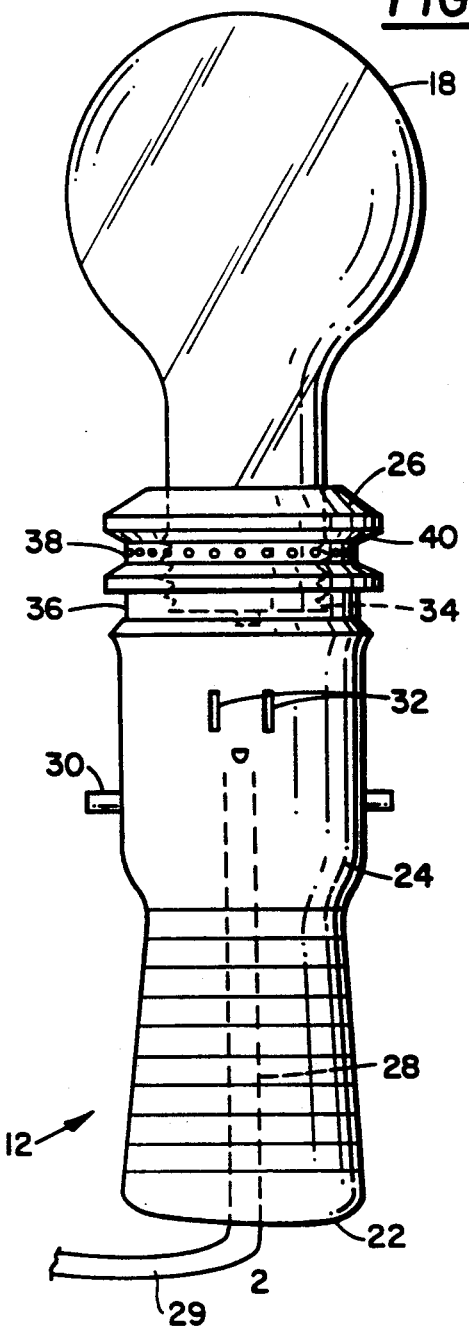
FIG. 3 is a front plan view of FIG. 1, with the cage and shield element removed.
Figure 4:
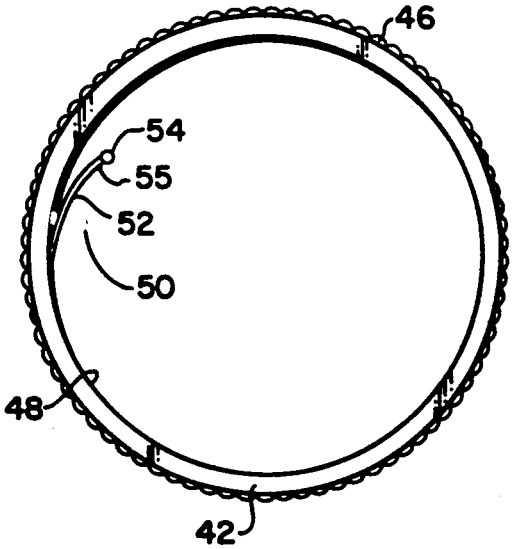
FIG. 4 is a top plan view of the ring member of the shield element provided in accordance with the principles of the present invention.

The handle assembly 12 may be constructed in any typical configuration, however, referring more particularly to FIG. 4, the preferred construction of the handle assembly 12 is shown. The handle assembly 12, having a generally cylindrical configuration, comprises a lower portion 22, a central portion 24, and an upper portion 26. The handle assembly 12 includes a bore 28 for receiving an electrical cord 29, for connecting to an electrical power source. The electrical cord 29 enters the housing assembly 12 at the lower portion 22 and extends to the central portion 24. The central portion 24 includes a switching member 30 which selectively allows electric current to flow to the light source 18 and thus turns the same on or off. The central portion 24 also includes an electrical outlet 32 which is supplied with electrical current from the power source through the electrical cord 29. The outlet 32 provides a source of electrical power for another lighting device or power tool for use in the work area. The upper portion 26 includes an electrical light socket 34, which is operatively coupled to the power source via the switching member 30 and electric cord 29. A light source 18, such as a light bulb, is disposed in the light socket 34. As shown in FIGS. 1 and 2, a protective cage 14 extends upwardly from the handle assembly 12 and encloses the light source. In the illustrative embodiment, the upper portion 26 of the handle assembly 12 includes a first groove 36 and a second groove 38 located above the first groove 36. The second groove 38 includes a plurality of dimples 40 located centrally about the entire extent of the second groove 38, as discussed more fully below.

The shield element 16, shown in FIG. 2, has a concave, shell-like configuration sized to envelope a part of the periphery of the light source 18. A ring member 42 is defined at end 44 of the movable shield element 16. The ring member 42 includes a knurled outer periphery 46 which defines a gripping surface and can be accessed through the cage 14. As shown in FIG. 4, affixed on the inner periphery 48 of ring 42, is a locking member, generally indicated at 50. In the preferred embodiment, the locking member 50, consists of a plate spring 52 having a ball 54 or like protuberance defined at end 55. The ring member 42 is slidably disposed in the second groove 38 of the upper portion 26 of the handle assembly 12 (FIG. 2). This positions the shield element 16 about the periphery of the light source 18 for directing the light emitted from the light source 18, and selectively shielding the worker's eyes.

As the ring member 42 is manually turned to rotate the shield element 16 to a desired position for directing light and shielding the user, the ball 54 of the plate spring 50 sequentially engages dimples 40 in the second groove 38, much like a typical ratchet assembly. Thus, the force of the plate spring 50 and engagement of ball 54 with dimple 40 of the second groove 38 can be overcome by manual means, but will resist unwanted rotation of the shield element 16 during use.

Preferably, the shield element is constructed of plastic material. However, a metallic material may be used which can reflect light to the work area, while shielding the worker's eyes.

As mentioned above and as best shown in FIGS. 1 and 2, disposed about the periphery of the light source 18 and shield element 16, is a cage assembly, generally indicated at 14, for protecting the light source 18. In the illustrative embodiment, the cage assembly 14 includes a ring element 56 sized to fit into the first groove 36 of the handle assembly 12. The ring element 56 is inserted into the first groove 36 to fix the cage assembly 14 in surrounding relation to the light source 18 and shield element 16. The cage 14 can be opened to gain access to the light source 18 at door 57. A hook 58 is affixed to the top of the cage assembly 14 to support the same in a balanced condition, when hanging the apparatus 10. The cage assembly is so configured and attached to the handle assembly 12, to define an opening 60 which provides access to the ring member 42 whereby the shield element 16 can be rotated through 360°, to direct light in any direction, and likewise shield the worker no matter his position. Likewise, if the worker moves, the shield can be adjusted accordingly without rehanging the apparatus 10.

It can be seen that the work-light apparatus 10 of the present invention provides an effective means of manually rotating a shield element to any desired location, independently of the hook or handle/cord assembly. Once the trouble-light is hung, or laid in a work area, the shield can be rotated to any desired position without unwanted rotation due to the electrical cord or disposition of the hook. Once the shield element is moved to the proper position, it will remain fixed until once again manually rotated.

While the invention has been described in connection with what is presently considered to be the most practical and preferred embodiment, it is understood that the invention is not limited to the disclosed embodiment, but, on the contrary, is intended to cover various modifications and equivalent arrangements included within the spirit and scope of the appended claims.

What is claimed is:

1. A trouble-light apparatus comprising:

a handle member including an upper portion, a central portion, and a lower portion from which an electrical cord extends for connecting to a power source, said upper portion including an electrical light socket for receiving a light source, said upper portion including a groove therein;

a shield member rotatably mounted to said handle member, said shield member having a concave, partial shell portion disposed about a portion of said light source;

a cage member extending upwardly from said upper portion of said handle member in surrounding relation to and spaced from said light socket and a light source received therein and enclosing said shield member without interfering with the movement of said shield; and a ring member rotatably engaged within said groove of said handle member for rotating said shield member defined within said cage member, said groove including a plurality of recesses defined therein, said ring member including means for lockingly engaging said recesses for resisting rotation relative to said handle member so as to hold said shield member in a selected disposition.

2. A trouble-light apparatus as defined in claim 1, wherein said central portion includes:

switching means which selectively allows electric current to flow to said light socket for turning a light source mounted therein on and off, and an electrical outlet supplied with electric current by said electrical cord.

3. A trouble-light apparatus as defined in claim 1, wherein said cage member has an opening defined therein adjacent said handle member to provide access to said ring member to allow manual rotation thereof to thereby rotate said shield member.

4. A trouble-light apparatus as defined in claim 1, wherein said cage member includes a first and second end, said first end including a ring element disposed in a second groove of said handle portion, said first end having an opening for accessing said ring member for manually rotating said shield member, said second end including a hook permanently affixed thereon for hanging the trouble-light apparatus, said cage member further including means defining a door for accessing said light socket and a light source mounted therein.

5. A trouble-light apparatus as defined in claim 1, wherein said shield member is formed from a plastic material.

6. A trouble-light apparatus as defined in claim 1, wherein said shield member is formed from a metal.

7. A trouble-light apparatus as defined in claim 1, wherein said ring member is defined at a lower end of said shield member.

8. A trouble-light apparatus as defined in claim 1, wherein said recesses comprise uniformly spaced concave dimples defined along the entire length of said groove and said means for lockingly engaging comprise:

a plate spring coupled at one end thereof to an inner periphery of said ring member and having a free end, and a ball element defined on said free end, said ball element sequentially lockingly engaging said dimples in said groove as said shield member is rotated, whereby said shield member is held in a selected position in the absence of a manual rotational force.

* * * * *